US010872548B2

(12) United States Patent
Zhao

(10) Patent No.: US 10,872,548 B2
(45) Date of Patent: Dec. 22, 2020

(54) DISPLAY APPARATUS FOR ALLEVIATING A PROBLEM OF IMAGE FLICKER BY REGULATING A COMMON VOLTAGE

(71) Applicants: HKC Corporation Limited, Shenzhen (CN); Chongqing HKC Optoelectronics Technology Co., Ltd., Chongqing (CN)

(72) Inventor: Wenqin Zhao, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 16/329,165

(22) PCT Filed: Jun. 28, 2018

(86) PCT No.: PCT/CN2018/093371
§ 371 (c)(1),
(2) Date: Feb. 27, 2019

(87) PCT Pub. No.: WO2019/184114
PCT Pub. Date: Oct. 3, 2019

(65) Prior Publication Data

US 2020/0013323 A1 Jan. 9, 2020

(30) Foreign Application Priority Data

Mar. 28, 2018 (CN) ..... 2018 1 0265558

(51) Int. Cl.
*G09G 3/36* (2006.01)
*G09G 3/20* (2006.01)

(52) U.S. Cl.
CPC ..... *G09G 3/20* (2013.01); *G09G 2310/08* (2013.01)

(58) Field of Classification Search
CPC ..... G09G 2310/027; G09G 2310/08; G09G 2320/0247; G09G 2320/0673;
(Continued)

(56) References Cited

U.S. PATENT DOCUMENTS 9,601,077 B2 * 3/2017 Lim ..... G09G 3/3696
2007/0057975 A1 * 3/2007 Oh ..... G09G 3/3648 345/690

(Continued)

FOREIGN PATENT DOCUMENTS

CN 101645244 A 2/2010
CN 107464520 A 12/2017

(Continued)

*Primary Examiner* — Ram A Mistry
(74) *Attorney, Agent, or Firm* — Muncy, Geissler, Olds & Lowe, P.C.

(57) ABSTRACT

This application provides a display apparatus and a driving method therefor. The display apparatus includes: a display panel, including a first input line and a first output line, where the first input line obtains a common voltage, and the first output line outputs a common feedback voltage; a voltage regulating unit, including a second output line, where the second output line outputs the common voltage; and a timing controller, including a control line and a second input line, where the control line outputs a voltage regulating signal, and the second input line obtains the common feedback voltage, where the timing controller continuously obtains the common feedback voltage, and selects, from common feedback voltage values, several voltage values as a regulation condition, and outputs the voltage regulating signal according to the regulation condition, where the (Continued)

voltage regulating unit regulates the common voltage according to the voltage regulating signal.

4 Claims, 6 Drawing Sheets

(58) Field of Classification Search
CPC ..... G09G 2330/021; G09G 2330/028; G09G 3/20; G09G 3/3655; G09G 3/3696
See application file for complete search history.

(56) References Cited

U.S. PATENT DOCUMENTS

| | | | | |
|---|---|---|---|---|
| 2013/0307761 | A1* | 11/2013 | Kwak | G02F 1/136286 345/87 |
| 2014/0132587 | A1 | 5/2014 | Tseng et al. | |
| 2016/0203769 | A1 | 7/2016 | Lee et al. | |
| 2017/0108970 | A1* | 4/2017 | Kim | G06F 3/0412 |
| 2019/0080663 | A1* | 3/2019 | Liu | G09G 3/3655 |

FOREIGN PATENT DOCUMENTS

| | | | |
|---|---|---|---|
| CN | 107564484 | A | 1/2018 |
| CN | 107591137 | A | 1/2018 |

* cited by examiner

DISPLAY APPARATUS FOR ALLEVIATING A PROBLEM OF IMAGE FLICKER BY REGULATING A COMMON VOLTAGE

BACKGROUND

Technical Field

This application relates to the field of display technologies, and in particular, to a display apparatus and a driving method therefor.

Related Art

In a display, a system board is connected to a control board (C-Board) by using a line, the control board is connected to a printed circuit board (PCB) by using, for example, a flexible flat cable (FFC), and the printed circuit board is then connected to a display area by using a source-chip on film (S-COF) and a gate-chip on film (G-COF). A driving manner of the display includes: The system board transmits a color (for example, R/G/B) compression signal, a control signal, and power to the control board. The signals are transmitted to a source circuit and a gate circuit of the printed circuit board after being processed by a timing controller (TCON) on the control board. Necessary data and power are transmitted to the display area by using the source-chip on film and the gate-chip on film, so that the display obtains power and signals required for image presentation.

However, the display works when being driven by voltage. In a display process, the display needs to first generate a common voltage VCOM. There is a direct numeric correspondence between voltage values of the common voltage VCOM and a highest voltage and a lowest voltage of the Gamma reference voltage used for display. In the related art, a reference voltage generating unit of the printed circuit board generates a reference voltage VREF. The reference voltage VREF and a ground voltage GND are transmitted to a voltage regulating unit. The voltage regulating unit is, for example, a digital voltage regulator (DVR) or a mechanical voltage regulator (VR). According to a voltage division principle, the voltage regulating unit may obtain a required common voltage VCOM through regulation and output the common voltage VCOM to a display panel.

However, when the common voltage VCOM and the Gamma reference voltage Gamma are unsymmetrical in numeric relationship, image flicker occurs. There are two common solutions to this problem.

(1) Sampling is performed on a panel after the panel is produced. An optimum common voltage VCOM_Y of the sampled panel is obtained through debugging, and then it is considered that an optimum common voltage VCOM of another display panel is the same as the optimum common voltage VCOM_Y of the sampled panel. A disadvantage of this solution is that, due to unstable manufacturing of a display panel in a manufacturing process, different display panels are different in manufacturing, leading to a difference between optimum common voltages VCOM of the different panels. Because the different display panels have different optimum common voltages VCOM, the optimum common voltages VCOM_Y are not definitely optimum. This causes image flicker.

(2) An optical sensor is added to a production line to detect image flicker strength and software is used to debug an optimum common voltage VCOM of each display panel. A common voltage VCOM occurring when the image flicker strength is the weakest is regarded as an optimum common voltage VCOM_Y of the display panel. A disadvantage of this solution is time-consuming and is not applicable to a product in which a printed circuit board (X board) is separated from a control board (C board). This is because the printed circuit board (X board) and the control board of this product are usually separately delivered, causing an error of an optimum VCOM when the panel is delivered to a client.

Further, working voltages of related components attenuate as use time increases. In addition, because attenuation speeds of voltage signals of the common voltage VCOM, the Gamma reference voltage Gamma and the like are inconsistent, after the display panel is used for a long time, the common voltage VCOM gradually deviates from an optimum voltage value. As a result, there are deviations of numeric relationships of the various voltages obtained by the display panel. This causes problems such as flicker.

SUMMARY

To resolve the foregoing technical problem, an objective of this application is to provide a display apparatus and a driving method therefor, so as to alleviate a problem such as image flicker of a display apparatus by regulating a common voltage.

The objective of this application is achieved and the technical problem of this application is resolved by using the following technical solutions. This application provides a display apparatus. The display apparatus comprises: a display panel, comprising a first input line and a first output line, where the first input line obtains a common voltage, and the first output line outputs a common feedback voltage; a voltage regulating unit, comprising a second output line, where the second output line outputs the common voltage; and a timing controller, comprising a control line and a second input line, where the control line outputs a voltage regulating signal, and the second input line obtains the common feedback voltage, where the timing controller continuously obtains the common feedback voltage, and selects, from common feedback voltage values, several voltage values as a regulation condition, and outputs the voltage regulating signal according to the regulation condition, where the voltage regulating unit regulates the common voltage according to the voltage regulating signal.

The technical problem of this application may be further resolved by taking the following technical measures.

In an embodiment of this application, the timing controller stores a voltage threshold, and the regulation condition is a deviation value calculated by the timing controller according to the several voltage values of the common feedback voltage values; and when the deviation value exceeds the voltage threshold, the timing controller outputs the voltage regulating signal, to control the voltage regulating unit to regulate the common voltage.

In an embodiment of this application, in a period in which the timing controller outputs the voltage regulating signal, when the deviation value is less than the voltage threshold, the timing controller stops sending the voltage regulating signal, so that the voltage regulating unit stops regulating the common voltage.

In an embodiment of this application, the timing controller continuously obtains n common feedback voltages in a period, comprising an $i^{th}$ common feedback voltage and a $i^{th}$ common feedback voltage, the deviation value is a difference between the $i^{th}$ common feedback voltage and the $i^{th}$ common feedback voltage, i, j, and n are positive integers, i and j are 1 or larger and do not exceed n, and i and j are not equal.

In an embodiment of this application, the timing controller continuously obtains the deviation value in a period of outputting the voltage regulating signal; and when the voltage regulating unit obtains a minimum deviation value from the deviation value and the minimum deviation value is less than the voltage threshold, the timing controller stops sending the voltage regulating signal, so that the voltage regulating unit stops regulating the common voltage.

In an embodiment of this application, the several voltage values of the common feedback voltage values comprise a maximum feedback voltage and a minimum feedback voltage.

In an embodiment of this application, when the timing controller controls the voltage regulating unit to regulate the common voltage, a voltage value range is regulated forward or backward by using the common voltage as a start.

In an embodiment of this application, the timing controller continuously obtains the common feedback voltage at a speed n times a frame rate, where n is an integer greater than 2.

In an embodiment of this application, the voltage regulating unit is a digital voltage regulator, where an analog or digital signal converter is set between the voltage regulating unit and the display panel, and the analog or digital signal converter converts the common feedback voltage into a digital signal.

In an embodiment of this application, the voltage regulating unit is a mechanical voltage regulator.

Another objective of this application is to provide a method for driving a display apparatus. The method comprises: continuously obtaining, by a timing controller, a common feedback voltage provided by a display panel; obtaining, by the timing controller, a maximum feedback voltage and a minimum feedback voltage from the common feedback voltage; calculating, by the timing controller, a deviation value according to the maximum feedback voltage and the minimum feedback voltage; and when the deviation value exceeds the voltage threshold, controlling, by the timing controller, the voltage regulating unit to regulate the common voltage, until the voltage regulating unit obtains a minimum deviation value from the deviation value and the minimum deviation value is less than the voltage threshold.

Still another objective of this application is to provide a display apparatus. The display apparatus comprises: a display panel, comprising a first input line and a first output line, where the first input line obtains a common voltage, and the first output line outputs a common feedback voltage; a voltage regulating unit, comprising a second output line, where the second output line outputs the common voltage; and a timing controller, comprising a control line and a second input line, where the control line outputs a voltage regulating signal, and the second input line obtains the common feedback voltage, where the timing controller continuously obtains the common feedback voltage at a speed twice a frame rate, obtains a maximum feedback voltage and a minimum feedback voltage from the common feedback voltage in a period, and the timing controller calculates a deviation value according to the maximum feedback voltage and the minimum feedback voltage; when the deviation value exceeds the voltage threshold, the timing controller outputs the voltage regulating signal, the voltage regulating unit regulates a voltage value range forward or backward by using the common voltage as a start according to the voltage regulating signal; and the timing controller continuously obtains the deviation value in a period of outputting the voltage regulating signal; and when the timing controller obtains a minimum deviation value from the deviation value and the minimum deviation value is less than the voltage threshold, the timing controller stops sending the voltage regulating signal, so that the voltage regulating unit stops regulating the common voltage.

According to this application, a premise of an existing production process may not be significantly changed and original manufacturing requirements and product coasts are maintained. Furthermore, after a display apparatus is used for a long time, a common voltage VCOM can maintain at a suitable voltage value and maintain a suitable numeric correspondence with a Gamma reference voltage, thereby resolving a problem of image flicker and unstable light of the display apparatus resulting from deviation of the common voltage from an optimum value. In addition, because the display apparatus can adaptively regulate the common voltage when being driven, this application is relatively applicable to various display apparatuses, and is applicable to a display and an electronic product whose components are delivered separately.

DETAILED DESCRIPTION

The following embodiments are described with reference to the accompanying drawings, which are used to exemplify specific embodiments for implementation of this application. Terms about directions mentioned in this application, such as "on", "below", "front", "back", "left", "right", "in", "out", and "side surface" merely refer to directions in the accompanying drawings. Therefore, the terms used about directions are used to describe and understand this application, and are not intended to limit this application.

The accompanying drawings and the description are considered to be essentially exemplary, rather than limitative. In the figures, modules with similar structures are represented by using the same reference number. In addition, for understanding and ease of description, the size and the thickness of each component shown in the accompanying drawings are arbitrarily shown, but this application is not limited thereto.

In the accompanying drawings, for clarity, thicknesses of a layer, a film, a panel, an area, and the like are enlarged. In the accompanying drawings, for understanding and ease of description, thicknesses of some layers and areas are enlarged. It should be understood that when a component such as a layer, a film, an area, or a base is described to be "on" "another component", the component may be directly on the another component, or there may be an intermediate component.

In addition, throughout this specification, unless otherwise explicitly described to have an opposite meaning, the word "include" is understood as including the component, but not excluding any other component. In addition, throughout the specification, "on" means that one is located above or below a target component and does not necessarily mean that one is on the top based on a gravity direction.

To further describe the technical measures taken in this application to achieve the intended application objective and effects thereof, specific implementations, structures, features, and effects of a display apparatus and a driving method therefor that are provided according to this application are described below in detail with reference to the drawings and specific embodiments.

Figure 1A:
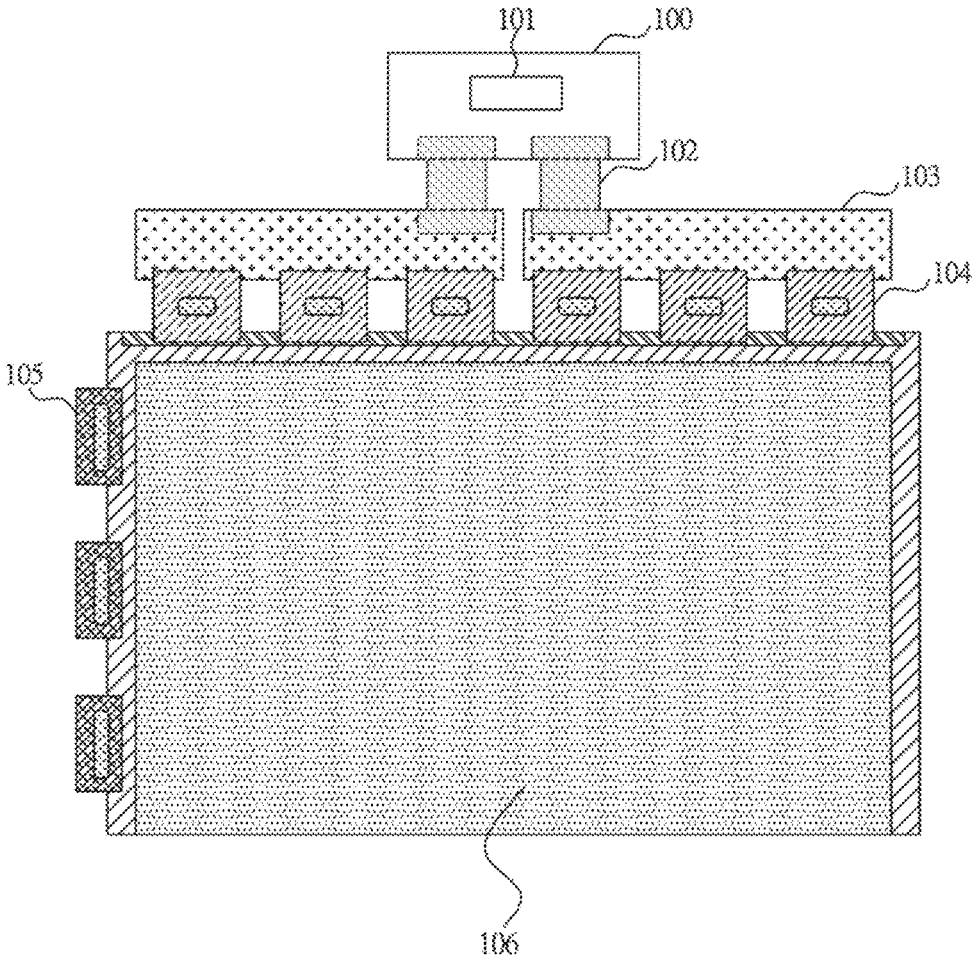
FIG. 1*a* is a schematic diagram of a configured structure of an exemplary display apparatus.
Figure 1B:
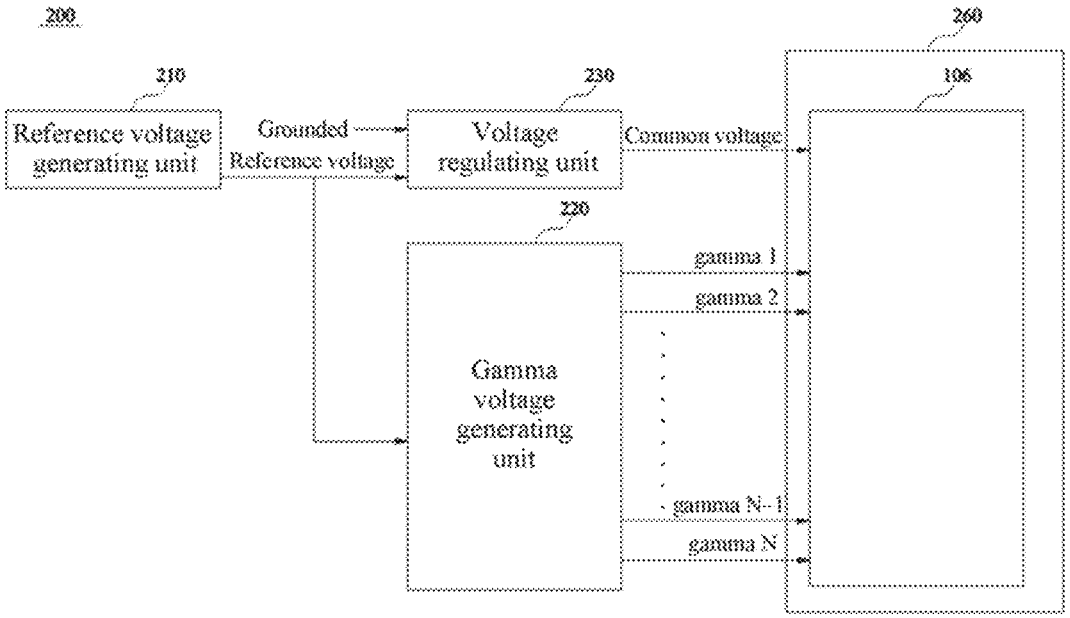
FIG. 1*b* is a partial schematic structural diagram of a driving circuit of an exemplary display apparatus.

FIG. 1*a* is a schematic diagram of a configured structure of an exemplary display apparatus. FIG. 1*b* is a partial schematic structural diagram of a driving circuit of an exemplary display apparatus. As shown in FIG. 1*a*, a driving manner of the display apparatus 200 includes: A system board transmits a color (for example, R/G/B) compression signal, a control signal, and power to a control board 100. The signals, after being processed by a timing controller (TCON) 101 on the control board 100, are transmitted, together with the power processed by a driving circuit, to a source circuit and a gate circuit on a printed circuit board 103 by using, for example, a flexible flat cable (FFC) 102. Necessary data and power are transmitted to a display area 106 by using a source-chip on film 104 and a gate-chip on film 105, so that a display obtains power and signals required for image presentation.

As shown in FIG. 1*b*, the display apparatus 200 includes: a reference voltage generating unit 210, a Gamma voltage generating unit 220 and a voltage regulating unit 230. The reference voltage generating unit 210 provides a reference voltage Vref to the Gamma voltage generating unit 220, the reference voltage Vref outputs a plurality of groups of Gamma reference voltages gamma 1, gamma 2, . . . , gamma N−1, and gamma N (N is usually 18 or 14) after being converted by the Gamma voltage generating unit 220. The plurality of groups of Gamma reference voltages is provided to the display area 106 of a display panel 260, to drive each pixel circuit of the display panel 260 with grayscale voltages of different values.

In a display process, the display apparatus 200 needs to first generate a common voltage VCOM. Generally, there is a direct numeric correspondence between voltage values of the common voltage VCOM and a highest voltage (for example, the gamma 1) and a lowest voltage (for example, the gamma N) of the Gamma reference voltage used for display. In the related art, the reference voltage generating unit 210 generates a reference voltage VREF. The reference voltage VREF and a ground voltage GND are transmitted to the voltage regulating unit 230. The voltage regulating unit 230 is, for example, a digital voltage regulator (DVR) or a mechanical voltage regulator (VR). According to a voltage division principle, the voltage regulating unit 230 may obtain a required common voltage VCOM through regulation and output the common voltage VCOM to the display area 106 of the display panel.

However, when the common voltage VCOM and the Gamma reference voltage Gamma are unsymmetrical in numeric relationship, image flicker occurs. In addition, because attenuation speeds of the common voltage VCOM, the reference voltage VREF and the Gamma reference voltage (gamma) are inconsistent, after the display panel is used for a long time, the common voltage VCOM gradually deviates from an optimum voltage value.

Figure 2:
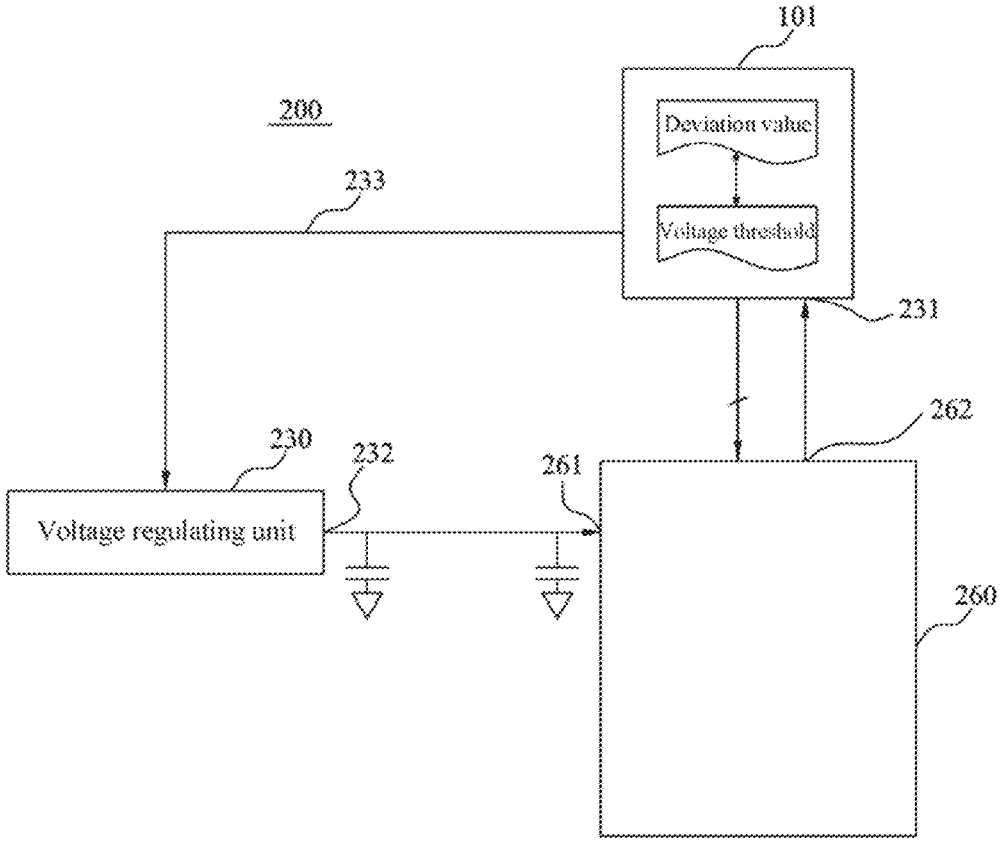
FIG. 2 is a schematic architectural diagram of a driving circuit of a display apparatus to which an embodiment of a method according to this application is applied.

FIG. 2 is a schematic architectural diagram of a driving circuit of a display apparatus to which an embodiment of a method according to this application is applied. In an embodiment of this application, a display apparatus 200 includes: a display panel 260, including a first input line 261 and a first output line 262, where the first input line 261 obtains a common voltage VCOM, and the first output line 262 outputs a common feedback voltage VCOM_R; a voltage regulating unit 230, including a second output line 232, where the second output line 232 outputs the common voltage VCOM; and a timing controller 101, including a control line 233 and a second input line 231, where the control line 233 outputs a voltage regulating signal, and the second input line 231 obtains the common feedback voltage VCOM_R, where the timing controller 101 continuously obtains the common feedback voltage VCOM_R, and selects, from common feedback voltage values VCOM_R, several voltage values as a regulation condition, and outputs the voltage regulating signal according to the regulation condition, where the voltage regulating unit 230 regulates the common voltage VCOM according to the voltage regulating signal.

In some embodiments, the timing controller 101 stores a voltage threshold Vth, and the regulation condition is a deviation value calculated by the timing controller 101 according to the several voltage values of the common feedback voltage values VCOM_R. When the deviation value exceeds the voltage threshold Vth, the timing controller 101 outputs the voltage regulating signal, to control the voltage regulating unit 230 to regulate the common voltage VCOM.

In some embodiments, the voltage threshold Vth is preset in an execution parameter or program of the timing controller 101, or is stored in a storage unit (not shown) of the display panel to be read by the timing controller 101.

In some embodiments, the timing controller 101 continuously obtains n common feedback voltages VCOM_R in a period, including an $i^{th}$ common feedback voltage VCOM_R and a $i^{th}$ common feedback voltage VCOM_R, the deviation value is a difference between the $i^{th}$ common feedback voltage VCOM_R and the $j^{th}$ common feedback voltage VCOM_R, i, j, and n are positive integers, i and j are 1 or larger and do not exceed n, and i and j are not equal.

In some embodiments, the period is preset in an execution parameter or program of the timing controller 101, or is stored in a storage unit (not shown) of the display panel 260 to be read by the timing controller 101.

In some embodiments, in a period in which the timing controller 101 outputs the voltage regulating signal (a period in which the voltage regulating unit 230 regulates the common voltage VCOM), when the deviation value is less than the voltage threshold Vth, the timing controller 101 stops sending the voltage regulating signal, so that the voltage regulating unit 230 stops regulating the common voltage VCOM.

In some embodiments, in a period in which the timing controller 101 outputs the voltage regulating signal (a period in which the voltage regulating unit 230 regulates the common voltage VCOM), the timing controller 101 continuously obtains the deviation value. When the voltage regulating unit 230 obtains a minimum deviation value from the deviation value and the minimum deviation value is less than the voltage threshold Vth, the timing controller 101 stops sending the voltage regulating signal, so that the voltage regulating unit 230 stops regulating the common voltage VCOM.

In some embodiments, the several voltage values of the common feedback voltage VCOM_R include a maximum feedback voltage VCOM_R(max) and a minimum feedback voltage VCOM_R(min).

In some embodiments, when the timing controller 101 controls the voltage regulating unit 230 to regulate the common voltage VCOM, a voltage value range VCOM_add, that is, a range of VCOM+VCOM_add to VCOM−VCOM_add, is regulated forward or backward by using the common voltage VCOM as a start.

In some embodiments, the voltage value range VCOM_add is preset in an execution parameter or program of the timing controller 101, or is stored in a storage unit (not shown) of the display panel 260 to be read by the timing controller 101.

In some embodiments, the timing controller 101 continuously obtains the common feedback voltage VCOM_R at a speed n times a frame rate, where n is an integer greater than 2.

Figure 3:
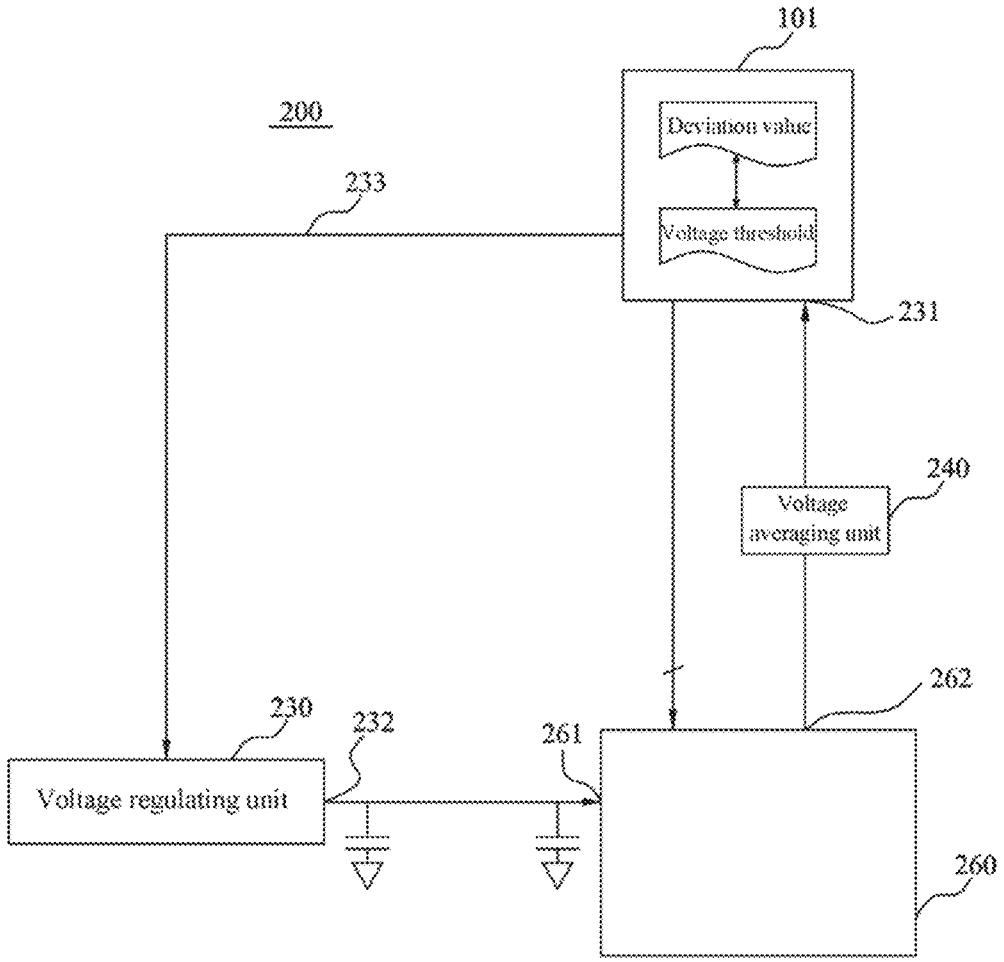
FIG. 3 is a schematic architectural diagram of a driving circuit of a display apparatus to which an embodiment of a method according to this application is applied.

FIG. 3 is a schematic architectural diagram of a driving circuit of a display apparatus to which an embodiment of a method according to this application is applied. In some embodiments, a voltage averaging unit 240 is set between the timing controller 101 and the display panel 260. The voltage averaging unit 240 continuously performs sampling on a voltage signal on the first output line 262, and provides an average value of sampled values as a common feedback voltage VCOM_R after a particular quantity of sampling times or after consecutive sampling is performed within a particular period.

Figure 4:
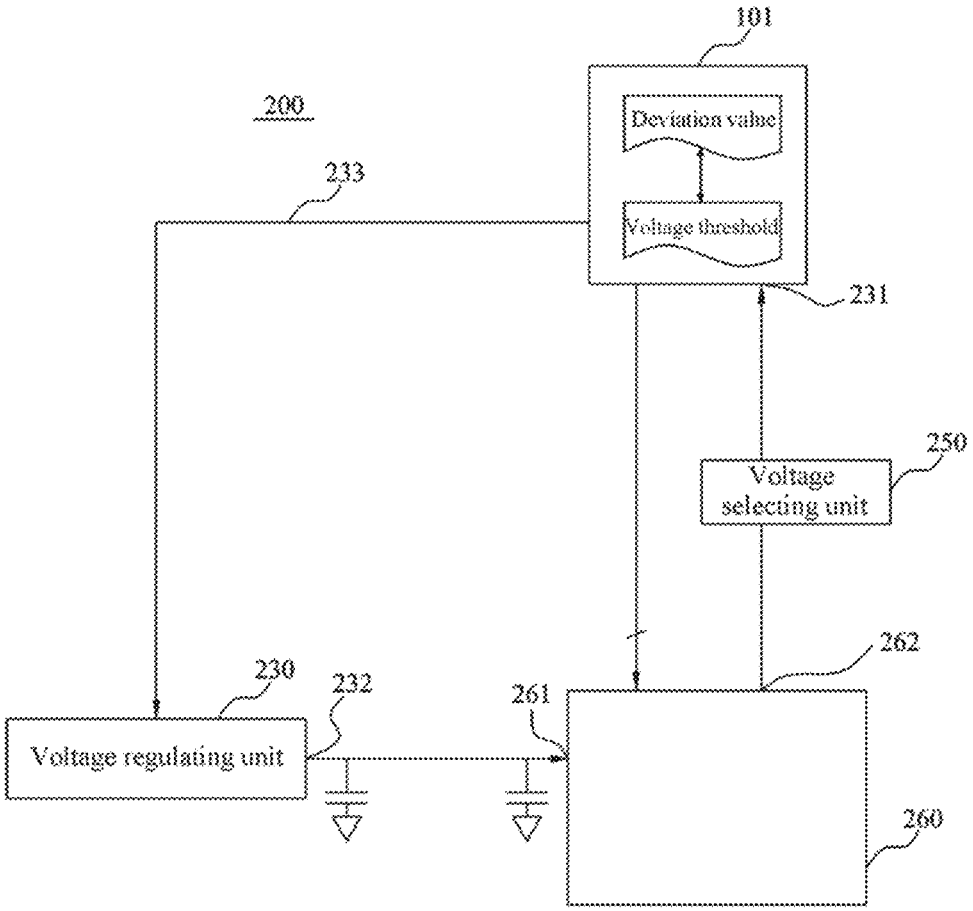
FIG. 4 is a schematic architectural diagram of a driving circuit of a display apparatus to which an embodiment of a method according to this application is applied.

FIG. 4 is a schematic architectural diagram of a driving circuit of a display apparatus to which an embodiment of a method according to this application is applied. In some embodiments, a voltage selecting unit 250 is set between the voltage regulating unit 230 and the display panel 260. The voltage selecting unit 250 continuously performs sampling on a voltage signal on the first output line 262 and, selects, after a particular quantity of sampling times or after consecutive sampling is performed within a particular period, one or more sampled values from all sampled values as a common feedback voltage VCOM_R, and then feeds back the common feedback voltage VCOM_R to the voltage regulating unit 230. A selection logic of the voltage selecting unit 250 is determined according to an actual requirement of a designer and is not limited.

In some embodiments, the voltage regulating unit 230 is a digital voltage regulator or a mechanical voltage regulator.

In some embodiments, when the voltage regulating unit 230 is a digital voltage regulator, an analog/a digital signal converter is set between the voltage regulating unit 230 and the display panel 260, to convert the common feedback voltage VCOM_R into a digital signal.

Figure 5:
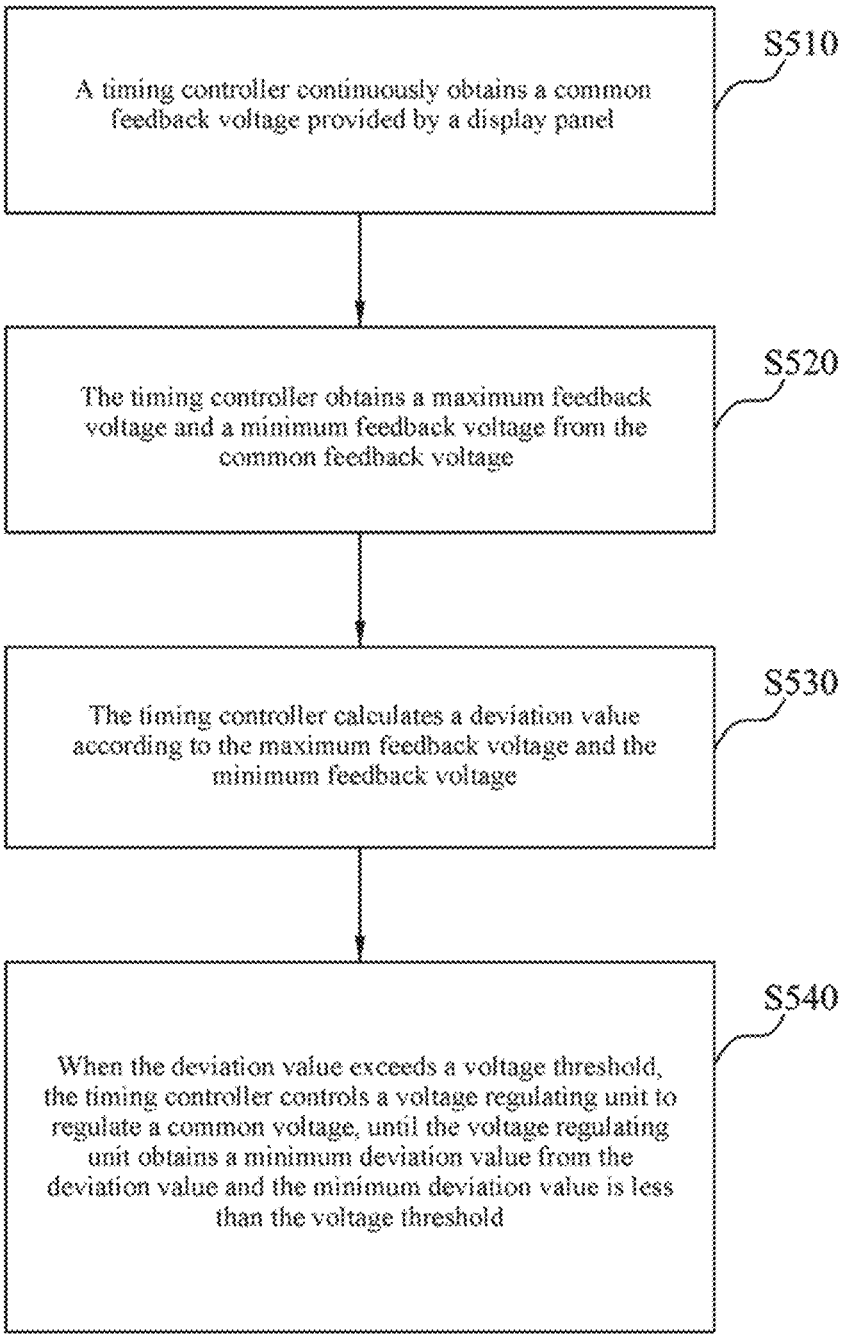
FIG. 5 is a schematic flowchart of driving of a display apparatus to which an embodiment of a method according to this application is applied.

FIG. 5 is a schematic flowchart of driving of a display apparatus to which an embodiment of a method according to this application is applied. In an embodiment of this application, a method for driving a display apparatus of this application includes:

Step S510: A timing controller 101 continuously obtains a common feedback voltage VCOM_R provided by a display panel 260;

Step S520: The timing controller 101 obtains a maximum feedback voltage VCOM_R(max) and a minimum feedback voltage VCOM_R(min) from the common feedback voltage VCOM_R;

Step S530: The timing controller 101 calculates a deviation value according to the maximum feedback voltage VCOM_R(max) and the minimum feedback voltage VCOM_R(min).

Step S540: When the deviation value exceeds the voltage threshold Vth, the timing controller 101 controls a voltage regulating unit 230 to regulate the common voltage VCOM, until the voltage regulating unit 230 obtains a minimum deviation value from the deviation value and the minimum deviation value is less than the voltage threshold.

In an embodiment of this application, a display apparatus 200 of this application includes: a display panel 260, including a first input line 261 and a first output line 262, where the first input line 261 obtains a common voltage VCOM, and the first output line 262 outputs a common feedback voltage VCOM_R; a voltage regulating unit 230, including a second output line 232, where the second output line 232 outputs the common voltage VCOM; and a timing controller 101, including a control line 233 and a second input line 231, where the control line 233 outputs a voltage regulating signal, and the second input line 231 obtains the common feedback voltage VCOM_R, where the timing controller 101 continuously obtains the common feedback voltage VCOM_R at a speed twice a frame rate, obtains a maximum feedback voltage VCOM_R(max) and a minimum feedback voltage VCOM_R(min) from the common feedback voltage VCOM_R in a period, and the timing controller 101 calculates a deviation value VCOM_R(max)−VCOM_R(min) according to the maximum feedback voltage VCOM_R (max) and the minimum feedback voltage VCOM_R(min); when the deviation value exceeds the voltage threshold Vth, the timing controller 101 outputs the voltage regulating signal, the voltage regulating unit 230 regulates a voltage value range VCOM_add forward or backward by using the common voltage VCOM as a start according to the voltage regulating signal; and the timing controller 101 continuously obtains the deviation value in a period of outputting the voltage regulating signal; and when the voltage regulating unit 230 obtains a minimum deviation value from the deviation value and the minimum deviation value is less than the voltage threshold Vth, the timing controller 101 stops sending the voltage regulating signal, so that the voltage regulating unit 230 stops regulating the common voltage VCOM.

In some embodiments, the display panel of this application may be, for example, a liquid crystal display panel, but is not limited thereto. The display panel may alternatively be an OLED display panel, a W-OLED display panel, a QLED display panel, a plasma display panel, a curved surface type display panel, or a display panel of another type.

According to this application, a premise of an existing production process may not be significantly changed and original manufacturing requirements and product coasts are maintained. Furthermore, after a display panel is used for a long time, a common voltage VCOM can still maintain at a suitable voltage value and maintain a suitable numeric correspondence with a Gamma reference voltage, thereby resolving a problem of image flicker and unstable light of the display panel resulting from deviation of the common voltage from an optimum value.

The wordings such as "in some embodiments" and "in various embodiments" are repeatedly used. The wordings usually refer to different embodiments, but they may also refer to a same embodiment. The words, such as "comprise", "have", and "include", are synonyms, unless other meanings are indicated in the context thereof.

The foregoing descriptions are merely specific embodiments of this application, and are not intended to limit this application in any form. Although this application has been disclosed above through the specific embodiments, the embodiments are not intended to limit this application. Any person skilled in the art can make some variations or modifications, namely, equivalent changes, according to the foregoing disclosed technical content to obtain equivalent embodiments without departing from the scope of the technical solutions of this application. Any simple amendment, equivalent change, or modification made to the foregoing embodiments according to the technical essence of this application without departing from the content of the technical solutions of this application shall fall within the scope of the technical solutions of this application.

What is claimed is:

1. A display apparatus, comprising:

a display panel, comprising a first input line and a first output line, wherein the first input line obtains a common voltage, and the first output line outputs a common feedback voltage;

a voltage regulating unit, comprising a second output line, wherein the second output line outputs the common voltage, and the voltage regulating unit is a digital voltage regulator and is electrically connected to the display panel; and a timing controller, comprising a control line and a second input line, wherein the control line outputs a voltage regulating signal, and the second input line obtains the common feedback voltage, wherein the timing controller is electrically connected to the display panel and the voltage regulating unit;

the timing controller continuously obtains the common feedback voltage at a speed twice a frame rate, obtains a maximum feedback voltage and a minimum feedback voltage from the common feedback voltage in a period, and the timing controller calculates a deviation value according to the maximum feedback voltage and the minimum feedback voltage;

when the deviation value exceeds the voltage threshold, the timing controller outputs the voltage regulating signal, the voltage regulating unit regulates a voltage value range forward or backward by using the common voltage as a start according to the voltage regulating signal; and the timing controller continuously obtains the deviation value in a period of outputting the voltage regulating signal; and when the timing controller obtains a minimum deviation value from the deviation value and the minimum deviation value is less than the voltage threshold, the timing controller stops sending the voltage regulating signal, so that the voltage regulating unit stops regulating the common voltage.

2. The display apparatus according to claim 1, wherein an analog or digital signal converter is set between the voltage regulating unit and the display panel.

3. The display apparatus according to claim 1, wherein the analog or digital signal converter converts the common feedback voltage into a digital signal.

4. A display apparatus, comprising:

a display panel, comprising a first input line and a first output line, wherein the first input line obtains a common voltage, and the first output line outputs a common feedback voltage;

a voltage regulating unit, comprising a second output line, wherein the second output line outputs the common voltage, and the voltage regulating unit is a mechanical voltage regulator and is electrically connected to the display panel; and a timing controller, comprising a control line and a second input line, wherein the control line outputs a voltage regulating signal, and the second input line obtains the common feedback voltage, wherein the timing controller is electrically connected to the display panel and the voltage regulating unit;

the timing controller continuously obtains the common feedback voltage at a speed twice a frame rate, obtains a maximum feedback voltage and a minimum feedback voltage from the common feedback voltage in a period, and the timing controller calculates a deviation value according to the maximum feedback voltage and the minimum feedback voltage;

when the deviation value exceeds the voltage threshold, the timing controller outputs the voltage regulating signal, the voltage regulating unit regulates a voltage value range forward or backward by using the common voltage as a start according to the voltage regulating signal; and the timing controller continuously obtains the deviation value in a period of outputting the voltage regulating signal; and when the timing controller obtains a minimum deviation value from the deviation value and the minimum deviation value is less than the voltage threshold, the timing controller stops sending the voltage regulating signal, so that the voltage regulating unit stops regulating the common voltage.

* * * * *